United States Patent [19]

Sorensen

[11] Patent Number: 4,538,317

[45] Date of Patent: Sep. 3, 1985

[54] CHIMNEY CLEANING APPARATUS

[76] Inventor: Maurice L. Sorensen, P.O. Box 92, Weyarhaeuser, Wis. 54895

[21] Appl. No.: 477,250

[22] Filed: Mar. 21, 1983

[51] Int. Cl.[3] ..... F23J 3/00

[52] U.S. Cl. ..... 15/163; 15/243

[58] Field of Search ..... 15/162, 163, 242, 243, 15/249; 248/163 A, 431, 434, 435

[56] References Cited

U.S. PATENT DOCUMENTS

| | | | |
|---|---|---|---|
| 606,567 | 6/1898 | Messenger | 15/162 X |
| 1,070,662 | 8/1913 | Bedford et al. | 15/163 X |
| 1,515,410 | 11/1924 | Renner | 15/249 |
| 1,569,203 | 1/1926 | Rice et al. | 15/243 X |
| 1,859,166 | 5/1932 | Premro | 15/163 |

FOREIGN PATENT DOCUMENTS

| | | | |
|---|---|---|---|
| 78479 | 12/1894 | Fed. Rep. of Germany | 15/163 |
| 163924 | 9/1933 | Switzerland | 248/163.5 |
| 566520 | 9/1975 | Switzerland | 15/243 |
| 119433 | 7/1918 | United Kingdom | 15/249 |

*Primary Examiner*—Peter Feldman

*Attorney, Agent, or Firm*—Andrus, Sceales, Starke & Sawall

[57] ABSTRACT

A chimney cleaning device includes a brush support housing mounted on top of the chimney, and a roller assembly at the base of the chimney for reciprocating the brush in the chimney flue. The brush support housing includes a hood for suspending the brush and a plurality of legs interpivotally associated with each other and the hood for adjusting the position of the legs to adapt to various sizes and types of chimney constructions. The roller assembly is insertable into the ashbox of the chimney and includes a frame for supporting a rotatable cable drum at one end and a pair of pulleys at its other end about which a pair of cables for moving the brush are trained. The roller assembly may be manually operated or motorized and includes a housing for supporting the frame within the ashbox which includes a door providing access to the interior for cleaning of the ashbox.

10 Claims, 5 Drawing Figures

CHIMNEY CLEANING APPARATUS

BACKGROUND OF THE INVENTION

The present invention relates to devices for cleaning chimney flues to remove objectionable soot, carbon, and creosote buildup therefrom, and more particularly to a chimney cleaning device that is adaptable to permit use with chmineys of various sizes and types of construction.

Fireplaces and coal or wood burning stoves have become popular for use in heating residential homes due to the ever increasing cost of electricity and natural gas. The use of such heating units, however, also poses the objectionable problem of creating a potential fire hazard in the chimney flue due to the buildup of soot, carbon, and creosote which results from the burning of wood or coal. It is thus desirable to provide an apparatus for cleaning the interior of chimney flues to remove these objectionable byproducts of combustion.

Various arrangements for cleaning the inside of chimney flues are known in the prior art. The traditional device is one which includes a brush attached to the end of a long handle. This device is inserted into the chimney flue from atop the roof by a chimney sweep. Such a device, however, suffers from the disadvantage that it must be operated from atop the roof or chimney and may not be operated by a person safely standing on the ground.

Other known chimney cleaning devices include those described in the following U.S. patents:

| U.S. Pat. No. | Inventor | Issue Date |
|---|---|---|
| 764,265 | Wensauer | Jul. 5, 1904 |
| 1,070,662 | Bedford et al | Aug. 19, 1913 |
| 1,297,090 | Campbell et al | Mar. 11, 1919 |
| 1,688,638 | Koss | Oct. 23, 1928 |
| 1,806,387 | Carney | May 19, 1931 |
| 1,859,166 | Premro | May 17, 1932 |
| 2,756,451 | Eklund | Jul. 31, 1956 |
| 4,028,769 | Coviello et al | Jun. 14, 1977 |
| 4,261,073 | Lane | Apr. 14, 1981 |

None of the above known prior art devices, however, offer the unique features of the present invention.

SUMMARY OF THE INVENTION

The chimney cleaning device includes a brush support housing mounted on top of the chimney that is readily adaptable for use with chimneys of various sizes and types of construction. In order to accomplish this flexibility, the brush support housing includes a hood from which a cleaning brush is suspended, and a plurality of legs interpivotally associated with each other and the hood. The lower ends of the legs may thus be readily adjustable about the corners of the top of the chimney. The support housing also includes means for securing the lower ends of the legs about the chimney to provide a sturdy mounting.

The chimney cleaning device may be easily operated by a person standing safely on the ground. In order to accomplish this objective, the cleaning device includes a roller assembly that is inserted into the ash cleanout box at the base of the chimney. The roller assembly includes a rotatable drum that may be manually operated or motorized for paying out and reeling in a pair of cables for reciprocation of the cleaning brush. The cable drum is rotatably mounted at one end of a frame which has a pair of pulleys mounted at its opposite end about which the cables are trained for moving the brush. The roller assembly also includes a housing which permits the frame to be readily slid into and supported within the ashbox. A door on the roller housing provides access to the interior for cleaning of the ashbox.

The present invention thus provides a chimney cleaning device which is conveniently and safely operated to efficiently clean a chimney flue. The device is readily adaptable for use with various sizes and types of chimney constructions.

BRIEF DESCRIPTION OF THE DRAWINGS

The drawings illustrate the best mode presently contemplated of carrying out the invention.

In the drawings.

DESCRIPTION OF THE PREFERRED EMBODIMENTS

Figure 1:
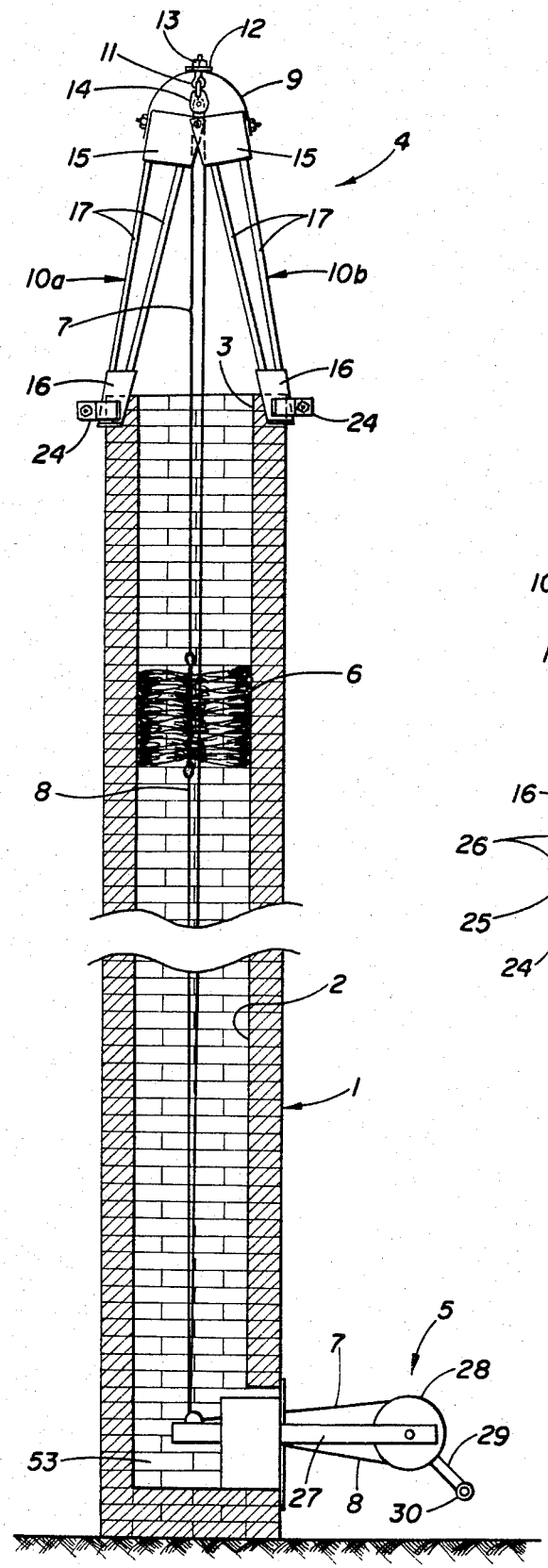
FIG. 1 is a side view in elevation of a chimney flue incorporating a chimney cleaning device constructed in accordance with the principles of the present invention.

Referring now to the drawings, FIG. 1 illustrates a chimney 1 made of any suitable masonry material that defines a flue 2 having a top opening 3. It should be noted that the chimney cleaning device of the present invention may be utilized with chimneys of various dimensions and types of construction so that the device hereinafter to be described is not limited to use with the specific chimney shown in FIG. 1.

The chimney cleaning device includes a brush support housing, generally designated by the numeral 4, mounted on top of chimney 1, and a roller assembly, generally designated by the numeral 5, mounted at the base of chimney 1 so as to be safely operable by a person standing on the ground. A brush 6 is suspended from support housing 4 within flue 2 and is reciprocally movable to remove soot, carbon, and creosote buildup therefrom. A pair of cables 7 and 8 interconnect brush 6 with the support housing 4 and roller assembly 5 to provide means for moving brush 6 within flue 2.

Figure 2:
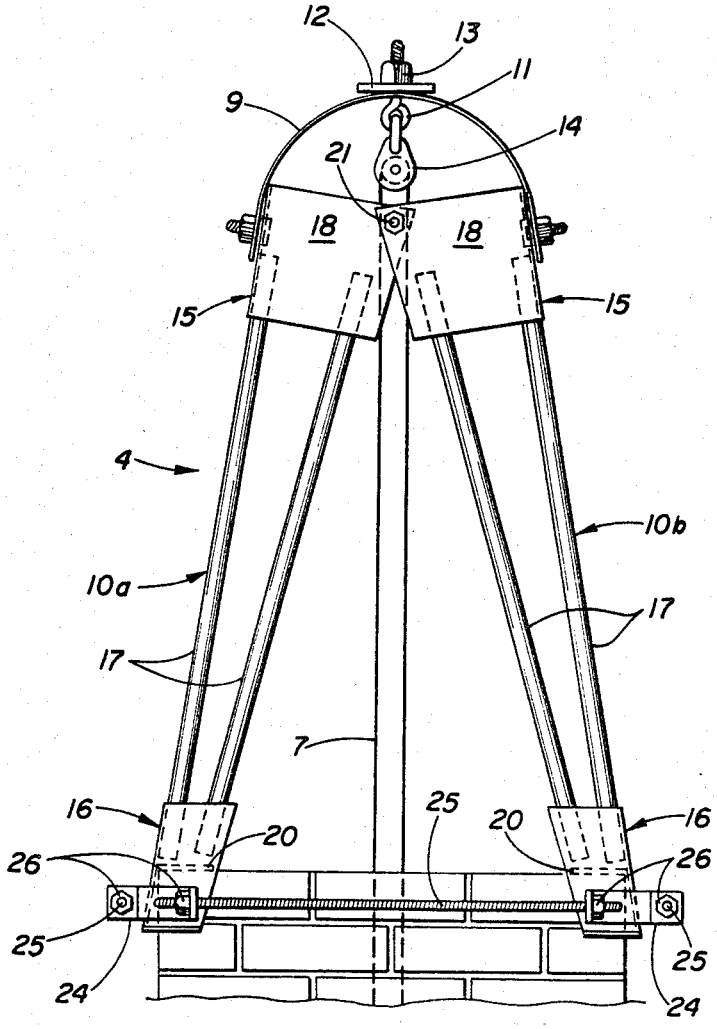
FIG. 2 is an end view in elevation illustrating the brush support housing of the chimney cleaning device of FIG. 1.
Figure 3:
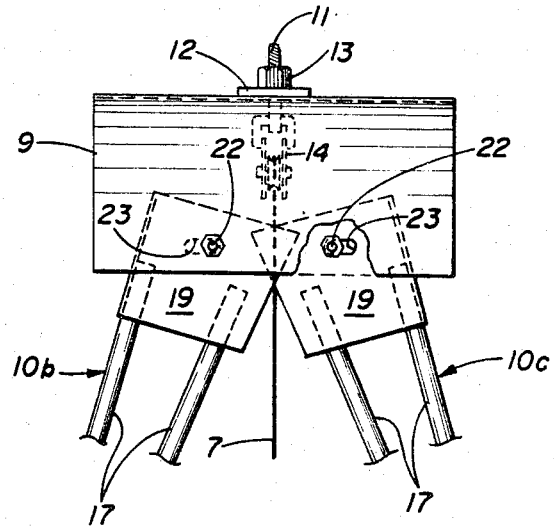
FIG. 3 is a fragmentary side view in elevation of the brush support housing of FIG. 2.

Referring now to FIGS. 2 and 3, brush support housing 4 includes a hood 9 and four legs 10*a*–10*d* (only legs 10*a*–10*c* being shown in FIGS. 2 and 3). Hood 9 is substantially U-shaped, and is preferably formed of sheet metal. An eyehook 11 extends through a central opening in hood 9, and is held in place by a washer 12 and nut 13. Eyehook 11 mounts a pulley 14 about which cable 7 is trained. The height of pulley 14 may be varied to adjust the tension on cable 7 by turning nut 13.

Legs 10*a*–10*d* extend downwardly from hood 9 to position hood 9 and pulley 14 in spaced relation directly above the top opening 3 of chimney 1. Legs 10*a*–10*d* each include an upper corner bracket 15, a lower corner bracket 16 and three tubes 17 interconnecting brackets 15 and 16. Each bracket 15 is formed of angled sheet metal and includes an end wall 18 and a side wall 19.

Each lower corner bracket 16 is also formed of angled sheet metal and includes an end wall and side wall. As shown in FIGS. 2 and 3, each leg 10*a*–10*d* includes three tubes 17 two of which extend between the edges of brackets 15 and 16 and the third of which extends between the corners of brackets 15 and 16. The upper and lower ends of tubes 17 may be welded or bolted to brackets 15 and 16 to provide a sturdy and rigid structure. Lower corner brackets 16 each include a brace 20 extending between its end wall and side wall. Braces 20 engage the top surface of chimney 1 and act as a locating means to properly position legs 10*a*–10*d* about the corners of chimney 1.

Legs 10*a*–10*d*. are adjustable to vary the positions of their lower corner brackets 16 so as to adapt to various sizes and types of constructions for chimney 1. In order to accomplish this, legs 10*a*–10*d* are interpivotally associated with each other and hood 3. These pivotal connections are provided by bolts 21 which interconnect end walls 18 of legs 10*a*–10*d*, and bolts 22 which interconnect side walls 19 of legs 10*a*–10*d* with hood 9. As seen best in FIG. 2, a bolt 21 extends through an opening formed in the upper lefthand corner of end wall 18 of bracket 15 for leg 10*b* and an opening formed in the upper righthand corner of end wall 18 of leg 10*a*. Bolt 21 is held in position by a nut (not shown) and provides a pivotal connection between legs 10*a* and 10*b*. An identical structure provides the pivotal connection between legs 10*c* and 10*d*. Referring now to FIG. 3, each bolt 22 extends through an opening formed in hood 9 and a slotted opening 23 formed in side wall 19 of brackets 15. Each bolt 22 is held in position by a nut (not shown) and thus provides a pivotal connection between legs 10*a*–10*d* and hood 9. Slotted openings 23 also permit legs 10*a*–10*d* to be adjusted endwise with respect to hood 9 depending upon the dimensions of the top of chimney 1. Thus, legs 10*a* and 10*b* may be pivoted with respect to each other on bolt 21 and with respect to legs 10*c* and 10*d* and hood 9 by means of bolts 22. Likewise, legs 10*c* and 10*d* may be pivoted with respect to each other by a second bolt 21, and may be pivoted with respect to legs 10*a* and 10*b* and hood 9 by means of bolts 22. These pivotal connections for legs 10*a*–10*d* permit the lower corner brackets 16 to be readily adjustable to the dimensions of the top of chimney 1. Thus, the pivotal connection provided by bolts 21 enable the legs 10*a*, 10*b*, and 10*c*, 10*d*, respectively, to move in a first directional plane, and the pivotal connection provided by bolts 22 enable the legs to move in a second directional plane transverse to the first plane.

In order to securely mount brush support housing 4 on top of chimney 1, there is provided four clamping brackets 24. Each bracket 24 is formed of angled metal to have an end wall, a side wall, and a pair of flanges extending outwardly from the edges of the end and side walls. Each flange includes an opening formed therethrough which is adapted to receive a threaded rod 25. A pair of nuts 26 may then be turned down upon the ends of each rod 25 to cause the lower brackets 16 to tightly bear against the corners of chimney 1 and secure the brush support housing 4 in place.

Figure 4:
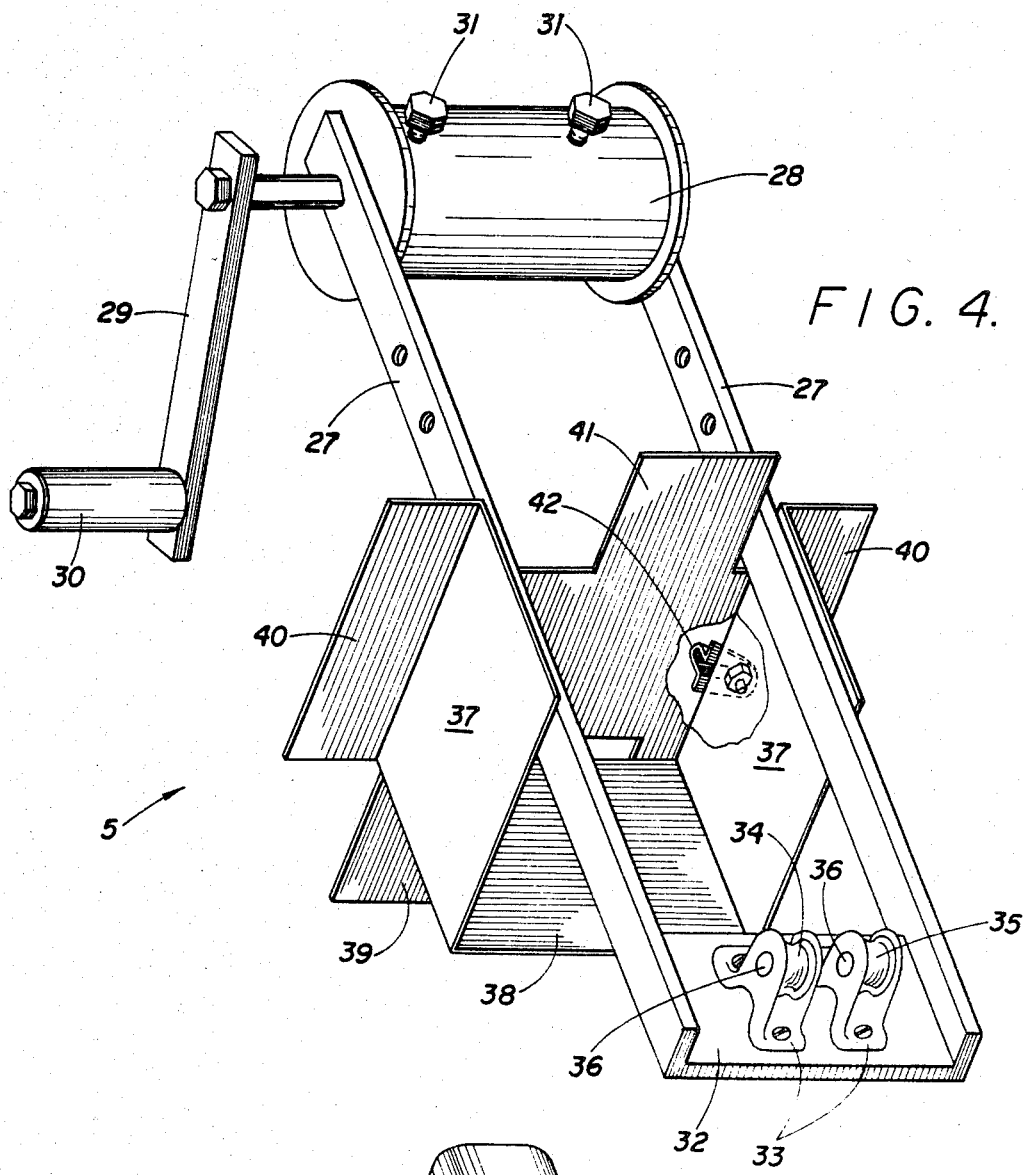
FIG. 4 is a perspective view of a manually operated roller assembly for the chimney cleaning device of FIG. 1.

FIG. 4 illustrates the manually operable roller assembly 5. Roller assembly 5 includes a frame defined by a pair of spaced apart longitudinal frame members 27. A cable drum 28 is rotatably mounted between the outer ends of members 27 and is operable to pay out or reel in cables 7 and 8 by means of a crank 29 and handle 30. Drum 28 also includes a pair of self-tapping screws 31 for attaching the ends of cables 7 and 8 thereto. A platform 32 also extends between frame members 27 and functions to brace their inner ends. A pair of brackets 33 are mounted on platform 32 for rotatably supporting cable pulleys 34 and 35 about pins 36. Cable 7 is trained about pulley 35 and cable 8, which is attached to the bottom of brush 6, is trained about pulley 34.

Roller assembly 5 also includes a housing which enables frame members 27 and pulley 34 and 35 to be slid within a conventional ash cleanout box 53 located in the bottom of flue 2 at the base of chimney 1. The housing includes a pair of opposite spaced apart side walls 37 each connected to one of frame members 27 between platform 32 and drum 28. A bottom wall 38 interconnects the lower edges of side walls 37, and includes a flange 39 extending downwardly from its front edge. Each side wall 37 also includes a flange 40 extending outwardly from its respective front edge. An ash door 41 is hinged to the front edge of bottom wall 38 and may be pivoted forwardly toward drum 28 to provide access to the ash cleanout box 53. When not in use, ash door 41 is held in an upright position by a latch 42 pivotally mounted on the flange 40 of side wall 37.

Roller assembly 5 may thus be slidably inserted into the ash cleanout box 53 so that pulleys 34 and 35 are located centrally within flue 2, and flanges 39 and 40 overlap the sides of the cleanout box to provide a closure therefor.

Figure 5:
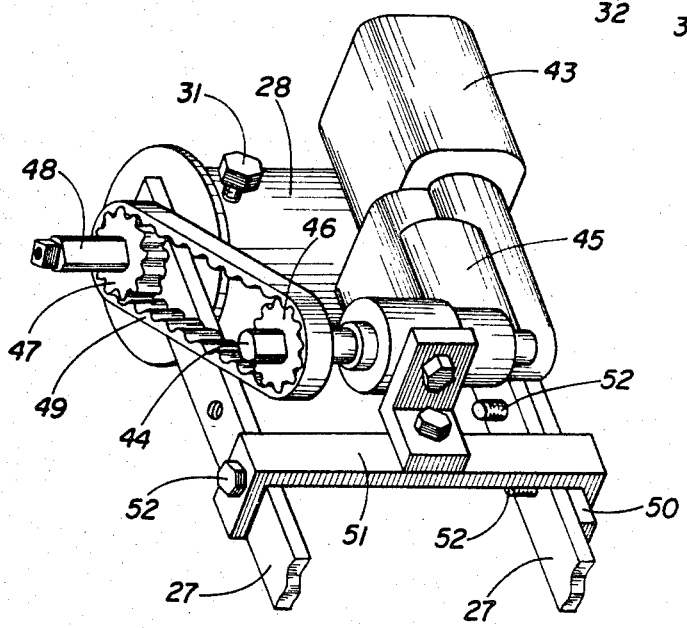
FIG. 5 is a fragmentary perspective view illustrating a motorized version of the assembly of FIG. 4.

FIG. 5 shows a motorized version of roller assembly 5. Instead of being manually rotated by means of crank 29, cable drum 28 is rotated by means of an electric motor 43. Motor 43 includes a shaft 44 driven through a gear box 45. Shaft 44 is operatively connected to cable drum 28 by means of a pinion gear or sprocket 46 mounted on the end of shaft 44, a second pinion gear or sprocket 47 mounted on the end of shaft 48 of drum 28, and a belt 49 looped around gears 46 and 47. Motor 43, gear box 45 and drive shaft 44 are mounted on an auxiliary frame which includes a side member and cross brace 51. Side member 50 is positioned adjacent frame member 27 and brace 51, is substantially channel-shaped as shown. Side member 50 and brace 51 are attached to frame members 27 by means of bolts 52 which pass therethrough. The auxiliary frame enables the manual version of roller assembly 5 shown in FIG. 4 to be readily converted to the motorized assembly of FIG. 5, if desired.

In order to assemble cables 7 and 8 to cable drum 28, the end of cable 7 is first passed around pulley 14 and attached to the top of brush 6 by means of a cable clamp. The other end of cable 7 is then run through pulley 35 and wrapped around drum 28. The first wrap is over drum 28 and progresses from left to right as shown in FIG. 4. The end of cable 7 is locked down by means of self-tapping screw 31 located on the righthand side of drum 28 as shown in FIG. 4. One end of cable 8 is first attached to the bottom of brush 6 by means of a cable clamp. The other end of cable 8 is then passed through pulley 34 and wrapped around drum 28. The first wrap passes under drum 28 and after one or two wraps, which progress from right to left as seen in FIG. 4, the end of cable 8 is locked down on drum 28 by means of self-tapping screw 31 on the left side of drum 28 as shown in FIG. 4.

In operation, after brush support housing 4 has been mounted on top of chimney 1, roller assembly 5 has been inserted within the chimney cleanout box, and cables 7 and 8 have been assembled to brush 6 and drum 28, drum 28 is rotated by means of crank 29 and handle 30 to move brush 6 vertically upwardly and downwardly within flue 2. During this operation, ash door 41 must be open so that cables 7 and 8 may readily be payed out and reeled in.

A chimney cleaning device has been illustrated and described which includes a brush support housing 4 mountable on top of a chimney 1, and a roller assembly 5 that may be inserted in the ashbox at the base of chimney 1 and operated by a person on the ground. The brush support housing 4 is adjustable to fit various chimney sizes and styles of construction.

Various modes of carrying out the invention are contemplated as being within the scope of the following claims particularly pointing out and distinctly claiming the subject matter which is regarded as the invention.

I claim:

1. A chimney cleaning device, comprising:

a brush support housing mountable on top of the chimney, said support housing including a support member and a plurality of legs each pivotally connected to said support member and to one of its adjacent legs at one of their ends for varying the position of their other ends in a first directional plane to accommodate chimneys of various dimensions;

pivotal means connected to said support member and said one ends of said legs for adjusting the pivotal connection of said legs with said support member for varying theposition of said one ends of said legs with respect to said support member in a second directional plane transverse to said first plane;

a cleaning brush suspended from said support housing for cleaning the inside of the chimney; and means for moving the cleaning brush up and down within the chimney.

2. The chimney cleaning device of claim 1, wherein each of said legs includes a corner bracket at said other end adapted to engage the outer corners of the chimney top.

3. The chimney cleaning device of claim 2, wherein each of said corner brackets includes positioning means for engaging the upper surface of the chimney adjacent the outer corners of the chimney top to properly locate the legs on said outer chimney corners.

4. The chimney cleaning device of claim 1, wherein said support member is a U-shaped hood.

5. The chimney cleaning device of claim 1, further including means for securing said legs to the chimney top.

6. The chimney cleaning device of claim 1, wherein said moving means is manually operated.

7. The chimney cleaning device of claim 1, wherein said moving means is motorized.

8. The chimney cleaning device of claim 1, wherein said moving means includes a cable means connected to the brush, and a roller assembly at the base of said chimney having a rotatable cable drum for reeling in and paying out said cable means.

9. The chimney cleaning device of claim 8, wherein said cable means includes a first cable connected to the top of said brush and associated with said support housing, and a second cable connected to the bottom of said brush.

10. The chimney cleaning device of claim 9, wherein said roller assembly further includes a frame having a pair of spaced apart frame members for supporting said cable drum therebetween at one end outside of said chimney, and a pair of pulleys mounted therebetween at the other end inside of said chimney, one of said pulleys associated with said first cable and the other of said pulleys associated with said second cable.

* * * * *